US009280170B2

(12) United States Patent
Okuda et al.

(10) Patent No.: US 9,280,170 B2
(45) Date of Patent: Mar. 8, 2016

(54) FIELD DEVICE

(71) Applicant: Azbil Corporation, Tokyo (JP)

(72) Inventors: Kouji Okuda, Tokyo (JP); Kentaro Ohya, Tokyo (JP); Hiroaki Nagoya, Tokyo (JP)

(73) Assignee: AZBIL CORPORATION, Tokyo (JP)

( * ) Notice: Subject to any disclaimer, the term of this patent is extended or adjusted under 35 U.S.C. 154(b) by 387 days.

(21) Appl. No.: 13/865,423

(22) Filed: Apr. 18, 2013

(65) Prior Publication Data

US 2013/0282191 A1 Oct. 24, 2013

(30) Foreign Application Priority Data

Apr. 18, 2012 (JP) ..... 2012-094494

(51) Int. Cl.
*G05F 5/00* (2006.01)

(52) U.S. Cl.
CPC ..... *G05F 5/00* (2013.01)

(58) Field of Classification Search
CPC ..... G05F 5/00
See application file for complete search history.

(56) References Cited

U.S. PATENT DOCUMENTS 5,280,223 A * 1/1994 Grabowski et al. ..... 318/139
5,418,677 A * 5/1995 Engel ..... 361/25
5,488,834 A * 2/1996 Schwarz ..... 62/126
6,087,735 A * 7/2000 Nakamura ..... 307/9.1
2001/0042649 A1* 11/2001 Maeda et al. ..... 180/65.4
2003/0020630 A1* 1/2003 Kawamata et al. ..... 340/825.53
2010/0253140 A1* 10/2010 Yamashita ..... 307/9.1
2012/0249019 A1* 10/2012 Okuda et al. ..... 318/135
2012/0249231 A1* 10/2012 Okuda et al. ..... 327/594
2012/0286723 A1* 11/2012 Ukita et al. ..... 320/107
2013/0238048 A1* 9/2013 Almendinger et al. ..... 607/40

FOREIGN PATENT DOCUMENTS

JP 3-212799 A 9/1991
JP 2004-151941 A 5/2004

* cited by examiner

*Primary Examiner* — Ramesh Patel
(74) *Attorney, Agent, or Firm* — Troutman Sanders LLP

(57) ABSTRACT

A field device has a primary power supply generating circuit that generates a primary power supply from an electric current that is supplied through a pair of electric wires from a higher-level system, and a calculation processing portion and various functional circuit portions, which operate based on a supply of an operating power supply electric current produced from the primary power supply. The field device also has an operating power supply electric current supplying unit that supplies the operating power supply electric current to a calculation processing portion with maximum priority. The calculation processing portion receives the operating power supply electric current supplied with maximum priority, clears a self-reset operation after starting up itself, and then directs sequentially, following a predetermined sequence, supply of the operating power supply electric current to each of the various functional circuit portions.

3 Claims, 5 Drawing Sheets

| Various Functional Circuit Portions | Startup Condition | Startup Sequence |
|---|---|---|
| A/D Converting Device | At Least IS2 | (1) |
| Driving Circuit | At Least IS3 | (2) |
| Sensor Circuit | At Least IS4 | (3) |
| Digital Circuit | At Least IS5 | (4) |

Background Art

Background Art

FIELD DEVICE

CROSS REFERENCE TO RELATED APPLICATION

This application claims priority to Japanese Patent Application No. 2012-094494, filed on Apr. 18, 2012, the entire content of which being hereby incorporated herein by reference.

FIELD OF TECHNOLOGY

The present invention relates to a field device, such as a positioner, that operates by generating a primary power supply from an electric current that is supplied through a pair of electric wires from a higher-level system.

BACKGROUND

Conventionally positioners, which are field devices that control the degrees of opening of regulator valves, are designed so as to operate with an electric current between 4 and 20 mA sent through a pair of electric wires from a higher-level system. For example, if a current of 4 mA is sent from the higher-level system, the opening of the regulator valve is set to 0%, and if a current of 20 mA is sent, then the opening of the regulator valve is set to 100%.

In this case, the electric current that is supplied from the higher-level system varies in the range of 4 mg through 20 mA, and thus the internal circuitry within the positioner produces its own operating power supply (the primary power supply) from an electric current of no more than 4 mA, which can always be secured as an electric current value that is supplied from the higher-level system. (See, for example, Japanese Unexamined Patent Application Publication 2004-151941.)

FIG. 5 is illustrates the critical components in a conventional positioner. This positioner 100 receives a supply of an electric current I through a pair of electric wires L1 and the L2 from the higher-level system 200 and produces a primary power supply from the electric current I that is supplied, and, on the other hand, also controls the degree of opening of a regulator valve, not shown, in accordance with the value of the supplied electric current I.

The positioner 100 is provided with a main circuit 3 that includes a CPU (calculation processing portion) 1 along with various types of functional circuit portions 2 (A/D converting devices, driving circuits for EPMs (electropneumatic converting devices), sensor circuits, digital circuits, and so forth), and a primary power supply generating circuit portion 4 that includes a zener diode D1. In this positioner 100, the primary power supply generating circuit portion 4 produces a constant voltage Vs from the supply electric current I from the higher-level system 200, and supplies that produced constant voltage Vs to the main circuit 3 as the primary power supply.

However, in the circuit structure illustrated in FIG. 5, even though the scope of the electric current of the supply electric current I wherein proper operation is possible is defined as a specification of the positioner 100, and even though there are no problems as long as the supplied electric current I ramps up quickly to the electric current range wherein proper operation is possible at the time of, for example, startup of the supply of power from the higher-level system 200 (referencing Curve I shown in FIG. 6), if the supplied electric current I changes slowly (referencing Curve II shown in FIG. 6), there is the risk that the main circuit 3 that includes the CPU 1 and the various types of functional circuit portions 2 will start up with the voltage generated by the primary power supply generating circuit portion 4 being inadequate, producing an erratic operating state, which may cause malfunctions such as a valve being opened unintentionally.

Note that Japanese Unexamined Patent Application Publication H3-212799 (the "JP '799 Application", issued as Japanese Patent 2753592) shows a double-wire instrument that receives the supply of power (a voltage) through a two-wire transmission line, measures a physical quantity, such as a flow rate, and transmits an electric current signal in accordance with the measured value. In this double-wire instrument, drops in the terminal voltage are monitored, and if a drop in the terminal voltage is detected, the microprocessor is initialized and a warning is sent. However, even though there has been an attempt to solve the problem with the positioner, set forth above, through the application of the technology disclosed in this JP '799 Application, given the following facts, the problem cannot be solved easily.

[Fact 1]

The double-wire instrument described in the JP '799 Application is a voltage input-type instrument, but the positioner is an electric current input-type device, and thus the mode of operation is different.

[Fact 2]

While a case wherein a fault occurs, such as a drop in the power supply voltage from a state wherein the double-wire instrument is operating normally, can be handled by the technology described in the JP '799 Application, it is not possible to detect whether or not there have been proper operations.

The present invention was created in order to solve such problems, and an aspect thereof is to provide a field device able to prevent the occurrence of faults due to the calculation processing portion or various types of functional circuit portions operating in an unstable state.

SUMMARY

In the aspect set forth above, the present invention is a field device comprising a primary power supply generating circuit for generating a primary power supply from an electric current that is supplied through a pair of electric wires from a higher-level system and a calculation processing portion and a variety of functional circuit portions that operate based on the supply of an operating power supply electric current produced from the primary power supply, comprising: operating power supply electric current supplying means for supplying the operating power supply electric current to the calculation processing portion with maximum priority; wherein the calculation processing portion receives the operating power supply current supplied with maximum priority, and, after starting up itself, clears a self-reset operation, and then directs sequentially, following a predetermined sequence, supply of the operating power supply electric current to each of the various functional circuits.

Given the present invention, a primary power supply generating circuit portion generates a primary power supply from an electric current that is provided through a pair of electric wires from a higher-level system, and the operating power supply current that is generated by the primary power supply is supplied, with maximum priority, to the calculation processing portion. The calculation processing portion receives the operating power supply current that is supplied with maximum priority, to clear a self-reset operation after the calculation processing portion has started up, after which the calculation processing portion sequentially directs, in a predetermined sequence, the supply of the operating power supply to the various functional circuit portions. As a result, at the time that the power supply is started up, the calculation processing portion is started up first, and after the calculation processing portion has started up, the various functional circuit portions are started up sequentially, in a predetermined sequence, following the direction from the calculation processing portion.

In the present invention, at the time that the power supply is started up, the calculation processing portion is started up first, and after the calculation processing portion has started up, the various functional circuit portions are started up sequentially, in a predetermined sequence, following the direction from the calculation processing portion, making it possible to prevent the occurrence of faults at the time of power supply startup, such as the calculation processing portion and the various functional circuit portions not starting up at all, or the calculation processing portion or the various functional circuit portions operating in an unstable state.

DETAILED DESCRIPTION

Figure 1:
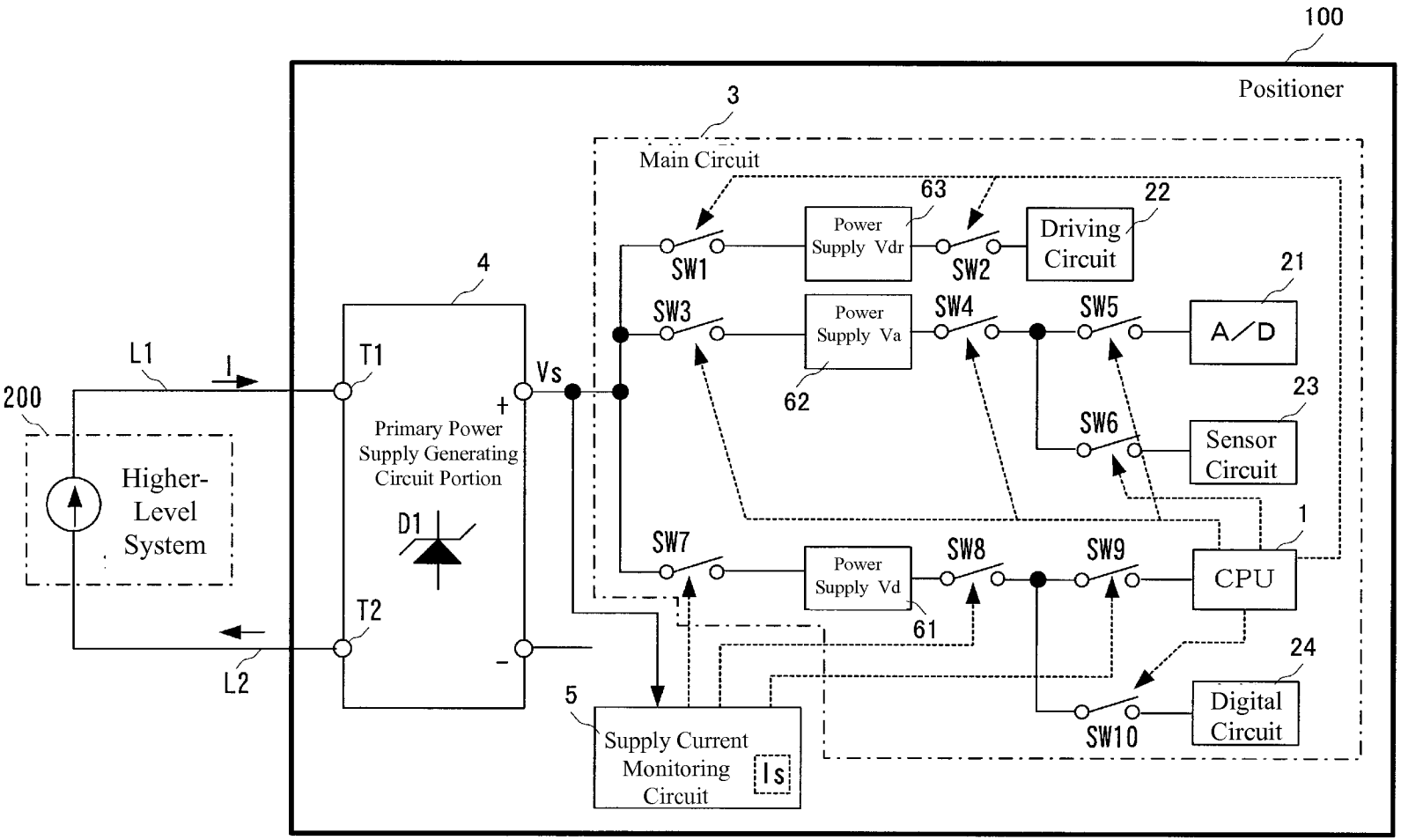
FIG. 1 is a structural diagram of the critical portions in an example of a field device according to the present invention.
Figure 5:
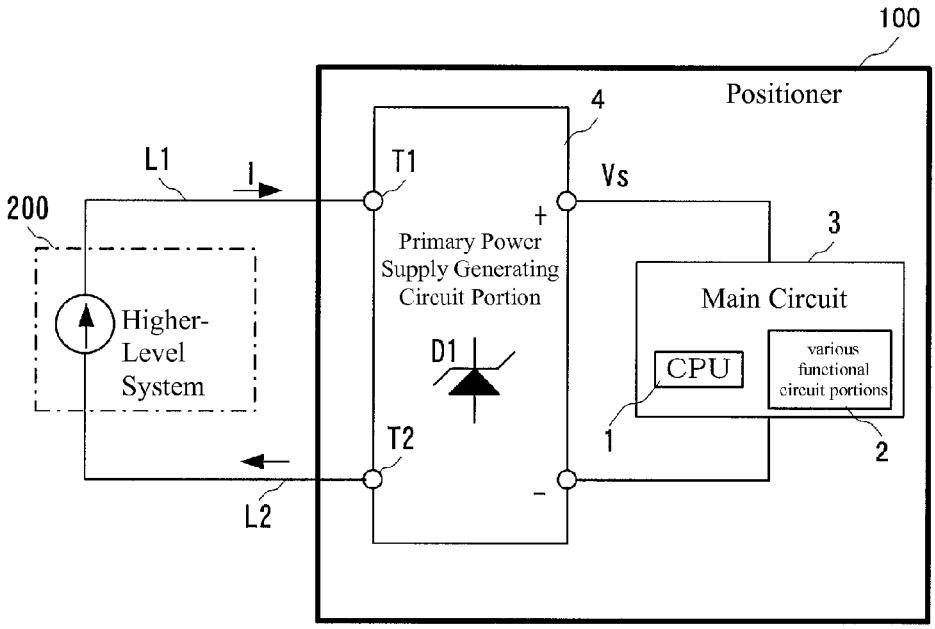
FIG. 5 is a diagram illustrating the critical components in a conventional positioner.
Figure 6:
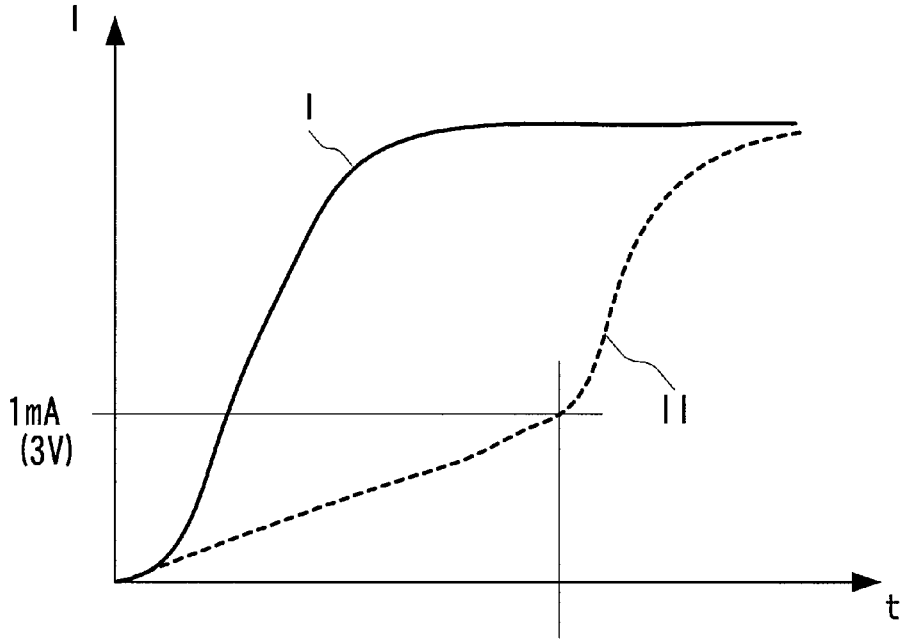
FIG. 6 is a diagram illustrating an example of varying the electric current supply I at the time of starting up the power supply.

An example according to the present invention will be explained below in detail, based on the drawings. FIG. 1 is a structural diagram of the critical portions in the example of a field device according to the present invention. In this figure, codes that are the same as those in FIG. 5 indicate identical or equivalent structural elements as the structural elements explained in reference to FIG. 5, and explanations thereof are omitted.

In the present example, the positioner 100 comprises, as various functional circuit portions in the main circuit 3, an A/D converting device 21, an EPM (electropneumatic converter) driving circuit 22, a sensor circuit 23, and a digital circuit 24.

Moreover, a supply current monitoring circuit 5 is provided for inputting the primary power supply Vs, generated by the primary power supply generating circuit portion 4, as the operating power supply current supplying means, to monitor, through this primary power supply Vs, the supply current Is that flows from the primary power supply generating circuit portion 4 and that can be supplied to the main circuit 3. Note that the supply current monitoring circuit 5 operates on an electric current that is substantially lower than the consumption current required in the main circuit 3.

In this positioner 100, a power supply circuit 61, for converting the primary power supply Vs, from the primary power supply generating circuit portion 4, into a voltage Vd that is suitable for the CPU 1 and the digital circuit 24, is provided in the stage prior to the CPU 1 and the digital circuit 24. Moreover, a power supply circuit 62 for converting from the primary power supply Vs, from the primary power supply generating circuit portion 4, into a voltage Va that is suitable for the A/D converting device 21 and the sensor circuit 23 is provided in the stage prior to the A/D converting device 21 and the sensor circuit 23. Moreover, a power supply circuit 63 for converting the primary power supply Vs, from the primary power supply generating circuit portion 4, into a voltage Vdr that is suitable for the driving circuit 22 is provided in the stage prior to the driving circuit 22.

Moreover, in this positioner 100, switches SW8 and SW9 are provided connected in series between the power supply circuit 61 and the supply line for the power supply to the CPU 1, and a switch SW10 is provided in the supply line for the power supply to the digital circuit 24 from the power supply circuit 61 through the switch SW8.

Moreover, switches SW4 and SW5 are provided connected in series between the power supply circuit 62 and the supply line for the power supply to the A/D converting device 21, and a switch SW6 is provided in the supply line for the power supply to the sensor circuit 23 from the power supply circuit 62 through the switch SW4.

Moreover, a switch SW2 is provided in the supply line for the power supply from the power supply circuit 63 to the driving circuit 22, and switches SW7, SW3, and SW1 are provided in the supply lines for the power supplies to the power supply circuits 61, 62, and 63 from the primary power supply generating circuit portion 4.

In this positioner 100, the supply current monitoring circuit 5 turns the switches SW7 through SW9 ON and OFF, and the CPU 1 turns the switches SW1 through SW6 and SW10 ON and OFF. Note that these switches SW1 through SW10 are fully OFF when in the power supply OFF state when the primary power supply Vs is not produced. The functions that are unique to the present example that has the supply current monitoring circuit 5 and the CPU 1 will be explained below, together with the operations thereof.

Figure 2:
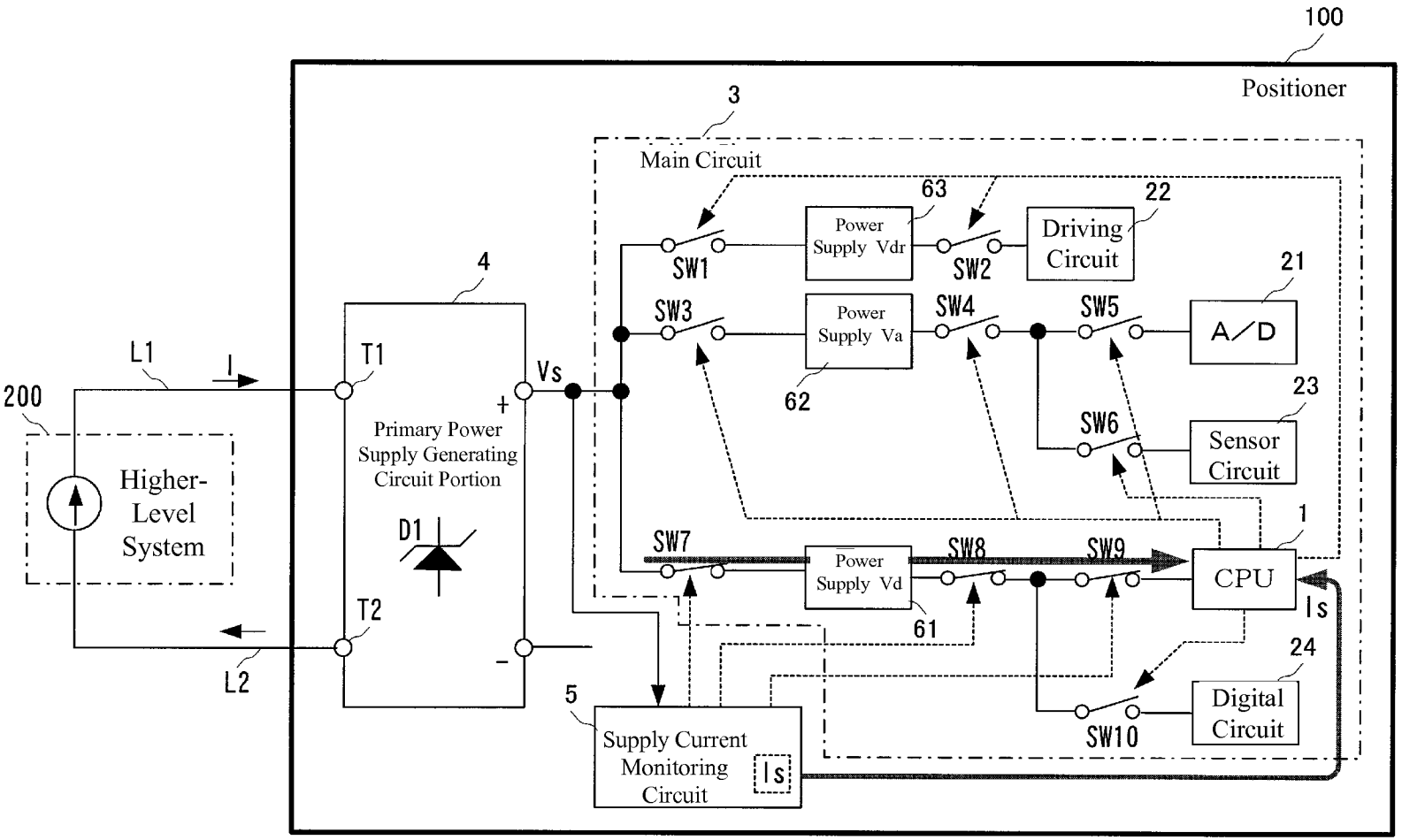
FIG. 2 is a diagram illustrating the state wherein the operating power supply current is supplied with maximum priority to the CPU in this field device (positioner).

When the power supply is started up by a higher-level system 200, that is, when the primary power supply Vs that is generated by the primary power supply generating circuit portion 4 is started up (when the power supply is started up), the supply current monitoring circuit 5 turns ON the switches SW7 through SW9 when the supply current Is that can be supplied to the main circuit 3 by the primary power supply Vs that is generated by the primary power supply generating circuit portion 4 rises above the electric current value required for starting up the CPU 1 (Is1) (point t1 in FIG. 4), and sends the electric current value of the supply current Is to the CPU 1 (FIG. 2).

As a result, the operating power supply current that is generated from the primary power supply Vs that is generated by the primary power supply generating circuit portion 4 is provided with the highest priority to the CPU 1, and the CPU 1 is started up by receiving the supply of this operating power supply current.

The CPU 1, after starting up, clears its own reset. Thereafter, it commences turning the switches SW1 through SW6 and SW10 ON/OFF based on the electric current value of the supply current Is from the supply current monitoring circuit 5.

Figures 3, 4:
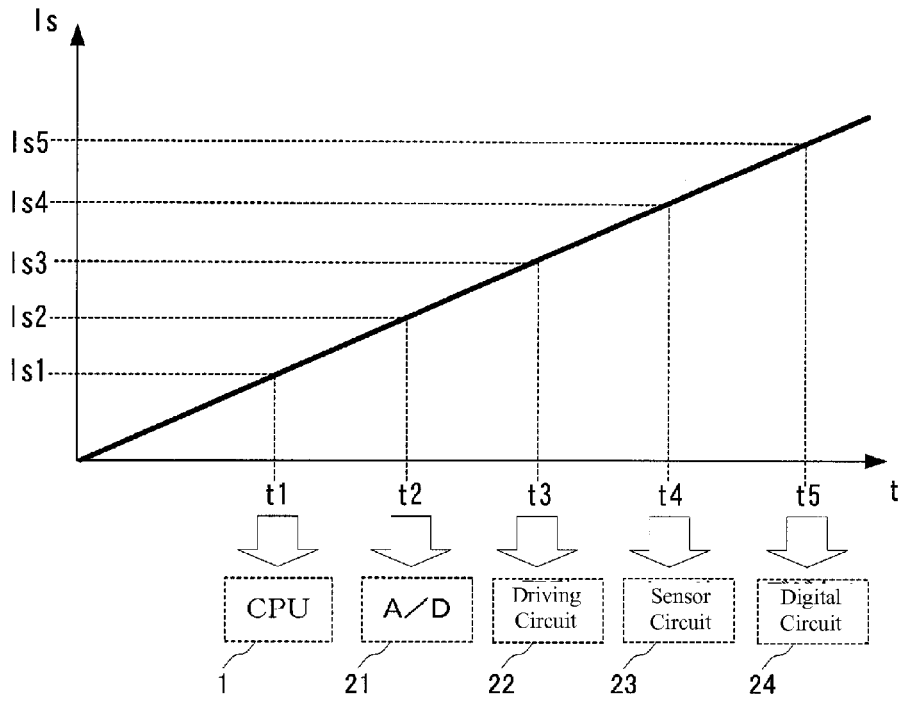
FIG. 3 is a diagram illustrating the startup sequence and startup conditions of the various functional circuit portions, established in relation to a CPU of the field device (positioner).
FIG. 4 is a diagram illustrating the relationships between the electric current values of the supply currents Is that are monitored by the supply current monitoring circuit of the field device (positioner) and the various functional circuit portions that are started up.

For the CPU 1, startup sequences and start up conditions are established, as illustrated in FIG. 3, for the A/D converting device 21, the driving circuit 22, the sensor circuit 23, and the digital circuit 24. In the present example, a startup sequence following a priority order is established, in, for example, the sequence of the A/D converting device 21, the driving circuit 22, the sensor circuit 23, and the digital circuit 24. Moreover, startup conditions based on the electric current values of the supply current Is are established, where, assuming, Is1<Is2<Is3<Is4<Is5, the startup condition for the A/D converting device 21 is that of being at least Is2, the startup condition for the driving circuit 22 is that of being at least Is3, the startup condition for the sensor circuit 23 is that of being at least Is4, and the startup condition for the digital circuit 24 is that of being at least Is5.

In accordance with this startup sequence and these startup conditions, if the electric current value of the supply current Is is at least Is2 (point t2 in FIG. 4), the CPU 1 turns the switches SW3, SW4, and SW5 ON, to start the supply of the operating power supply current from the primary power supply generating circuit portion 4 to the A/D converting device 21.

Following this, if the electric current value of the supply current Is is at least Is3 (point t3 in FIG. 4), the CPU 1 turns the switches SW1 and SW2 ON, to start the supply of the operating power supply current from the primary power supply generating circuit portion 4 to the driving circuit 22.

Similarly, thereafter, if the electric current value of the supply current Is is at least Is4 (point t4 in FIG. 4), the CPU 1 turns the switch SW6 ON, to start the supply of the operating power supply current from the primary power supply generating circuit portion 4 to the sensor circuit 23, and if the electric current value of the supply current Is is at least Is5 (point t4 in FIG. 5), turns the switch SW10 ON, to start the supply of the operating power supply current from the primary power supply generating circuit portion 4 to the digital circuit 24.

As a result, in the present example, when starting up the primary power supply Vs that is generated by the primary power supply generating circuit portion 4 (when starting up the power supply), first the CPU 1 is started up, and then after the CPU 1 is started up, the various functional circuit portions (the A/D converting device 21, the driving circuit 22, the sensor circuit 23, and the digital circuit 24) are started up sequentially in a specific sequence following directions from the CPU 1.

As a result, the present example prevents the occurrence of faults such as the CPU 1 and the various functional circuit portions (the A/D converting device 21, the driving circuit 22, the sensor circuit 23, and the digital circuit 24) not starting up at all or the CPU 1 and the various functional circuit portions (the A/D converting device 21, the driving circuit 22, the sensor circuit 23, and the digital circuit 24) starting up again an unstable state when the power supply is started up.

Note that while in the example set forth above the startup followed the sequence of the A/D converting device 21, the driving circuit 22, the sensor circuit 23, and the digital circuit 24, this is no more than one example of a sequence, and obviously the sequence is not limited thereto. Moreover, the various functional circuit components were merely listed as the A/D converting device 21, the driving circuit 22, the sensor circuit 23, and the digital circuit 24 as one example, and there is no limitation thereto.

Furthermore, while the supply of the power supply to the various functional circuit portions may be through turning ON/OFF the supply of the power supply itself as illustrated in the example set forth above, if there are sleep function terminals, or if, in programmable settings, there are, for example, functions for stopping operation, such as a power-down function (wherein the current consumed is extremely small), those functions may be used instead.

EXTENDED EXAMPLES

While the present invention has been explained above in reference to an example, the present invention is not limited to the example set forth above. The structures and details in the present invention may be varied in a variety of ways, as can be understood by one skilled in the art, within the scope of technology in the present invention.

The invention claimed is:

1. A field device comprising:

a primary power supply circuit that produces operating power from a controlling amperage supplied by an external system, a central processing unit, and various functional circuit portions which operate on the operating power produced from the primary power supply circuit, a supply current monitoring circuit that supplies operating power exclusively to the central processing unit during startup, wherein the central processing unit resets itself to default operation after starting itself up and then directs operating power sequentially, following a predetermined sequence, to each of the various functional circuit portions.

2. The field device as set forth in claim 1, wherein the predetermined sequence by which the central processing unit directs operating power to the various functional circuit portions is a start up sequence which satisfies startup conditions that are established for each of the various functional circuit portions.

3. The field device as set forth in claim 2, wherein the supply current monitoring circuit monitors a supply current from the primary power supply circuit, where if the supply current is at least sufficient for starting up the central processing unit, the supply current monitoring circuit supplies operating power to the central processing unit and outputs a value of the supply current being monitored to the central processing unit; and the central processing unit evaluates whether or not the startup conditions that are established for each of the various functional circuit portions have been fulfilled, based on the value of the supply current outputted by the supply current monitoring circuit to the central processing unit.

* * * * *